US006769143B2

(12) United States Patent
Clarke

(10) Patent No.: US 6,769,143 B2
(45) Date of Patent: Aug. 3, 2004

(54) BEDDING STORAGE CONTAINER

(76) Inventor: Preston O. Clarke, 151 First Ave., #187, New York, NY (US) 10003

( * ) Notice: Subject to any disclaimer, the term of this patent is extended or adjusted under 35 U.S.C. 154(b) by 0 days.

(21) Appl. No.: 10/073,767

(22) Filed: Feb. 11, 2002

(65) Prior Publication Data

US 2003/0150056 A1 Aug. 14, 2003

(51) Int. Cl.[7] ..... A47C 21/02
(52) U.S. Cl. ..... 5/58; 5/504.1; 5/658
(58) Field of Search ..... 5/504.1, 503.1, 5/658, 37.1, 58; 383/22; 297/188.06

(56) References Cited

U.S. PATENT DOCUMENTS 1,176,598 A * 3/1916 Pollgreen ..... 190/111
1,453,372 A * 5/1923 Wong ..... 297/64
1,608,064 A * 11/1926 Henry ..... 297/329
1,656,339 A * 1/1928 Runyan ..... 224/275
1,673,257 A * 6/1928 McKenna ..... 297/329
1,681,979 A * 8/1928 Graham ..... 297/357
1,702,284 A * 2/1929 Thien et al. ..... 297/354.13
1,788,088 A * 1/1931 Fabio ..... 297/362.14
1,928,177 A * 9/1933 Hirschfeld ..... 297/64
1,984,207 A 6/1934 Ceslowitz
2,094,410 A * 9/1937 Redding ..... 297/365
2,261,519 A * 11/1941 Jones ..... 297/65
2,297,176 A * 9/1942 Thompson ..... 297/64
2,543,167 A * 2/1951 Hening et al. ..... 297/319
2,563,564 A 8/1951 Thomas
2,576,343 A * 11/1951 Hibbard et al. ..... 297/65
2,579,921 A 12/1951 Gibbs
2,588,071 A 3/1952 Arton
2,622,659 A * 12/1952 Stelmack ..... 248/397
2,655,197 A * 10/1953 Schofield ..... 297/319
2,691,175 A 10/1954 Brahm et al.
2,704,109 A * 3/1955 Ripley ..... 297/188.04
2,711,213 A * 6/1955 Owens ..... 248/231.81
2,761,481 A * 9/1956 Boatwright ..... 383/22
2,792,575 A 5/1957 Jorgensen et al.
2,981,311 A * 4/1961 Hacker ..... 297/65
3,014,759 A * 12/1961 Bing ..... 297/188.06
3,193,324 A * 7/1965 Stock ..... 297/64
3,479,085 A * 11/1969 Weinstein ..... 297/228.1
3,596,981 A * 8/1971 Koziol ..... 297/154
3,784,993 A 1/1974 Berkowitz
3,867,730 A * 2/1975 Wright ..... 5/42.1
3,887,229 A * 6/1975 Plume ..... 297/65
3,910,630 A * 10/1975 Runyon et al. ..... 297/63
3,957,071 A * 5/1976 Kenner ..... 135/66
3,964,785 A * 6/1976 Plume ..... 297/64
4,186,859 A * 2/1980 Frankfort et al. ..... 224/579
4,235,350 A * 11/1980 Valentino ..... 5/503.1 X
4,240,480 A * 12/1980 Strobel ..... 383/15
4,266,704 A * 5/1981 Swanson ..... 224/543
4,339,061 A * 7/1982 Dunn ..... 224/407
4,444,431 A * 4/1984 Suzuki ..... 297/316
4,484,367 A * 11/1984 Jenkins ..... 5/425
4,487,451 A * 12/1984 Fiorini ..... 297/219.1
4,512,504 A * 4/1985 Owlett ..... 224/572
4,573,225 A 3/1986 Wolf (List continued on next page.)

OTHER PUBLICATIONS

Maurice Gershman, M.D., "Self–Adhering Nylon Tapes," Journal of A.M.A. (Oct. 18, 1958), vol. 168, No. 7.*

*Primary Examiner*—Robert G. Santos
(74) *Attorney, Agent, or Firm*—Thompson Coburn LLP

(57) ABSTRACT

A bedding storage container includes a pouch, and at least one strap attached to the pouch. The pouch has a front wall, a rear wall, and two side walls thereby forming a storage area. The at least one strap adjustably attaches the pouch to a futon frame assembly. A lid is hingedly attached to the rear wall. The front wall has a lip as an upper edge thereof. The lid is selectably positionable over the lip. As desired, the lid has openings formed thereupon. The openings receive buttons attached to the front wall, thereby securing the container in a closed position.

25 Claims, 3 Drawing Sheets

U.S. PATENT DOCUMENTS 4,852,778 A * 8/1989 Beiser et al. ..... 224/417
4,961,522 A * 10/1990 Weber ..... 224/585
4,974,760 A * 12/1990 Miller ..... 224/407
5,012,963 A * 5/1991 Rosenbaum ..... 224/407
5,040,711 A * 8/1991 Niederhauser et al. ..... 224/572
5,139,308 A * 8/1992 Ziman ..... 297/188.06
5,326,175 A * 7/1994 Carter ..... 383/22
5,340,005 A * 8/1994 Woods et al. ..... 224/407
5,370,246 A * 12/1994 Traynor ..... 211/86.01
5,407,111 A * 4/1995 Lanouette et al. ..... 224/579
5,417,353 A * 5/1995 Stall ..... 224/401
5,511,710 A * 4/1996 Woods et al. ..... 224/407
5,513,789 A * 5/1996 Woods et al. ..... 224/407
5,526,924 A * 6/1996 Klutznick ..... 206/5
5,544,745 A * 8/1996 Famorca ..... 206/320
5,628,442 A * 5/1997 Wayne ..... 224/543
5,651,152 A * 7/1997 Ritchie et al. ..... 5/503.1
5,699,564 A * 12/1997 Heh ..... 5/503.1
5,702,038 A * 12/1997 Miller et al. ..... 224/409
5,788,329 A * 8/1998 Pilarczyk et al. ..... 297/354.13
5,813,064 A * 9/1998 Hartenstine ..... 5/658 X
5,860,702 A * 1/1999 Pilarczyk et al. ..... 297/354.13
5,941,437 A * 8/1999 Okumura ..... 224/585
5,954,398 A * 9/1999 Namba et al. ..... 297/257
D418,295 S * 1/2000 Verhulst ..... D3/283
D420,510 S * 2/2000 Rotan ..... D3/303
6,030,034 A * 2/2000 Plohetski ..... 297/188.06
6,148,459 A * 11/2000 Verhulst ..... 5/503.1
6,174,082 B1 * 1/2001 Pelky et al. ..... 383/22
6,233,765 B1 * 5/2001 Verhulst ..... 5/503.1
6,292,963 B1 * 9/2001 Couture ..... 5/503.1
6,402,000 B1 * 6/2002 Stark ..... 224/572
6,439,636 B1 * 8/2002 Kuo ..... 296/65.09
6,502,900 B1 * 1/2003 Johnston ..... 297/188.06
2002/0056736 A1 * 5/2002 Conte ..... 224/407
2002/0066762 A1 * 6/2002 Stark ..... 224/543
2003/0150056 A1 * 8/2003 Clarke ..... 5/58

* cited by examiner

BEDDING STORAGE CONTAINER

BACKGROUND OF THE INVENTION

This invention relates to a bedding storage container and more particularly to a bedding storage container that attaches to a back of a vertical portion of a futon.

Convertible beds and their associated bedding are well known in the art. Generally, beds are taught which store in a collapsed or reduced state, such as, for example, convertible sofas. Such beds can be unfolded, extended, or otherwise opened out to accommodate humans at rest in a supine, prone, or other position as commonly found when humans are sleeping. The art also includes such examples as wedge bolster bedding holders (See U.S. Pat. No. 3,784,993). More recent innovations in the bedding industry have resulted in a widespread use of a futon for use as both a couch by day, and a bed by night. Futons are typically used by people who have limited space in their dwellings and who therefore choose to optimize commitment of scarce square footage in living space to the placement of their furniture. Such people are often living on a limited budget. Although many variations of futons are found in commerce, a common problem faced by futon users everywhere is that they must find an acceptable location to store the bedding, such as, for example, sheets, blankets, and pillows, associated with their futon. The use of such acceptable locations, such as, for example, closets and footlockers, typically requires the encumbrance of additional space in a dwelling, thereby further compounding the problem of saving space in dwellings of limited square footage. Thus, what is needed is a bedding storage container which is compact, utilizes little or no additional square footage, is simple to use, and has a low production and acquisition cost.

SUMMARY OF THE INVENTION

It is an object of the present invention to provide a bedding storage container that allows a user to store bedding behind a vertical surface of a piece of furniture.

It is a further object of the present invention to provide a bedding storage container that allows a user to store bedding behind a vertical surface of a futon.

It is even another object of the present invention to provide a bedding storage container that adapts to and is used in conjunction with an existing futon.

More particularly, the present invention provides a bedding storage container detachably mounted to a futon frame. A futon mattress is removably positioned to rest upon the futon frame. The bedding storage container includes a pouch. The pouch is detachably secured to the futon frame by straps that are adjustably affixed to the futon frame. The pouch includes a storage area within the pouch. Bedding, such as, for example, sheets, blankets, pillows, and the like, is positioned within the storage area of the pouch as desired by the user. A lid is secured to the pouch. The lid is selectably positioned over a lip of the pouch to close the pouch as desired by the user. A fastening means, such as, for example, openings formed along the lid in alignment with corresponding buttons affixed to the pouch, is used in order to secure the lid in a closed position.

BRIEF DESCRIPTION OF THE DRAWINGS

A better understanding of the invention will be had upon reference to the following description in conjunction with the accompanying drawings in which like numerals refer to like parts throughout the several views and wherein.

DETAILED DESCRIPTION OF THE PREFERRED EMBODIMENT

Figure 1:
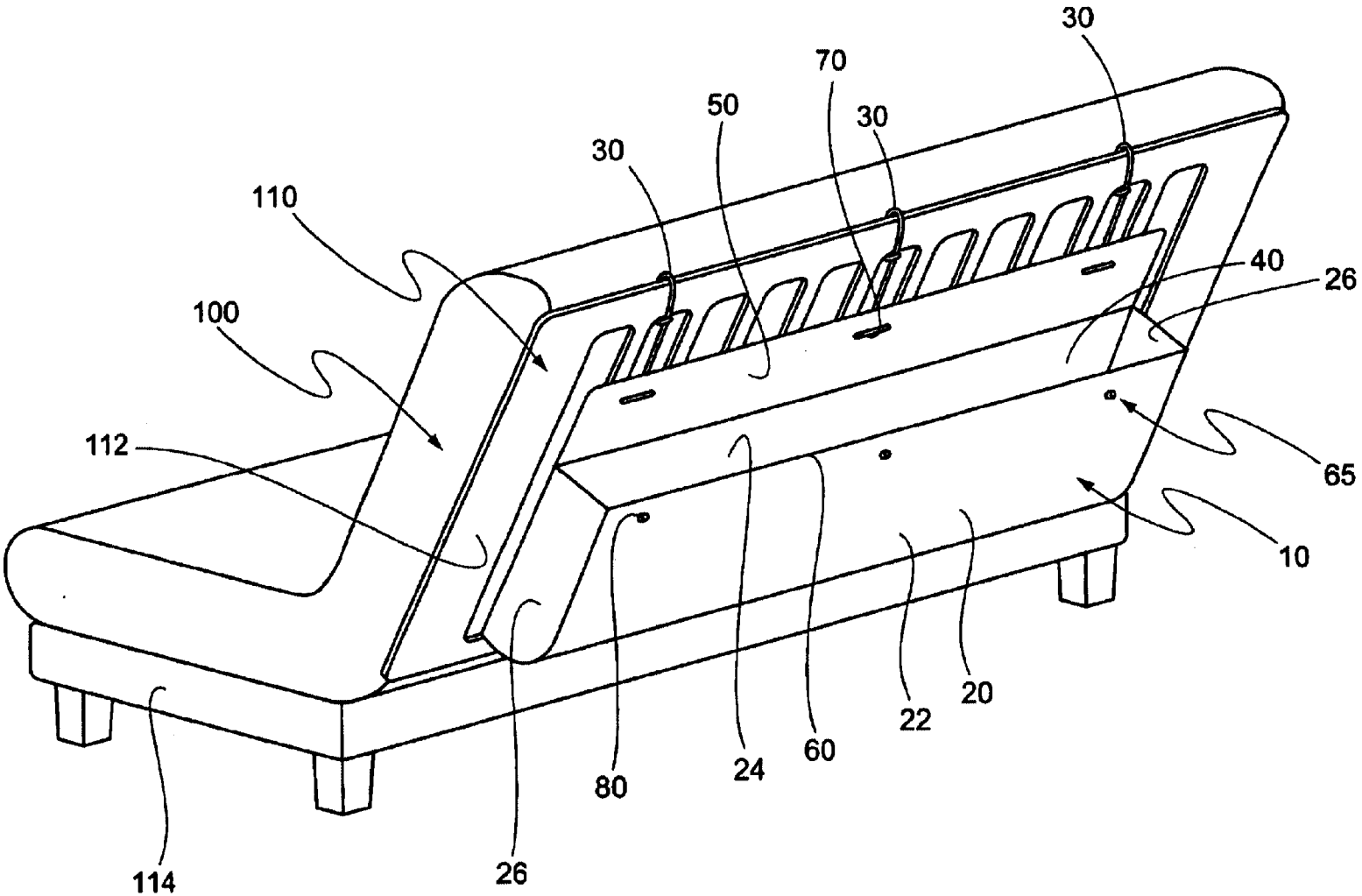
FIG. 1 is a perspective view of one preferred embodiment of the present invention.

FIG. 1 shows a preferred embodiment of the present invention. A bedding storage container is designated generally by the numeral 10. The bedding storage container 10 is detachably mounted to futon 100. The futon 100 includes a futon frame assembly 110 having a vertical surface 112 and a horizontal surface 114. A futon mattress 120 is removably positioned to rest upon both the vertical surface 112 and the horizontal surface 114 of the futon frame assembly 110.

The bedding storage container 10 includes a pouch 20. The pouch 20 has a front wall 22 having a lip 60 as an upper edge, a rear wall 24, and side walls 26. The pouch 20 is detachably secured to the futon frame assembly 110 by at least one strap 30 and by three straps 30 in a preferred embodiment. The straps 30 are adjustably affixed to and received by a variety of geometric configurations of futon frame assemblies 110. Walls 22, 24 and 26 form a storage area 40 within the pouch 20.

Figure 2:
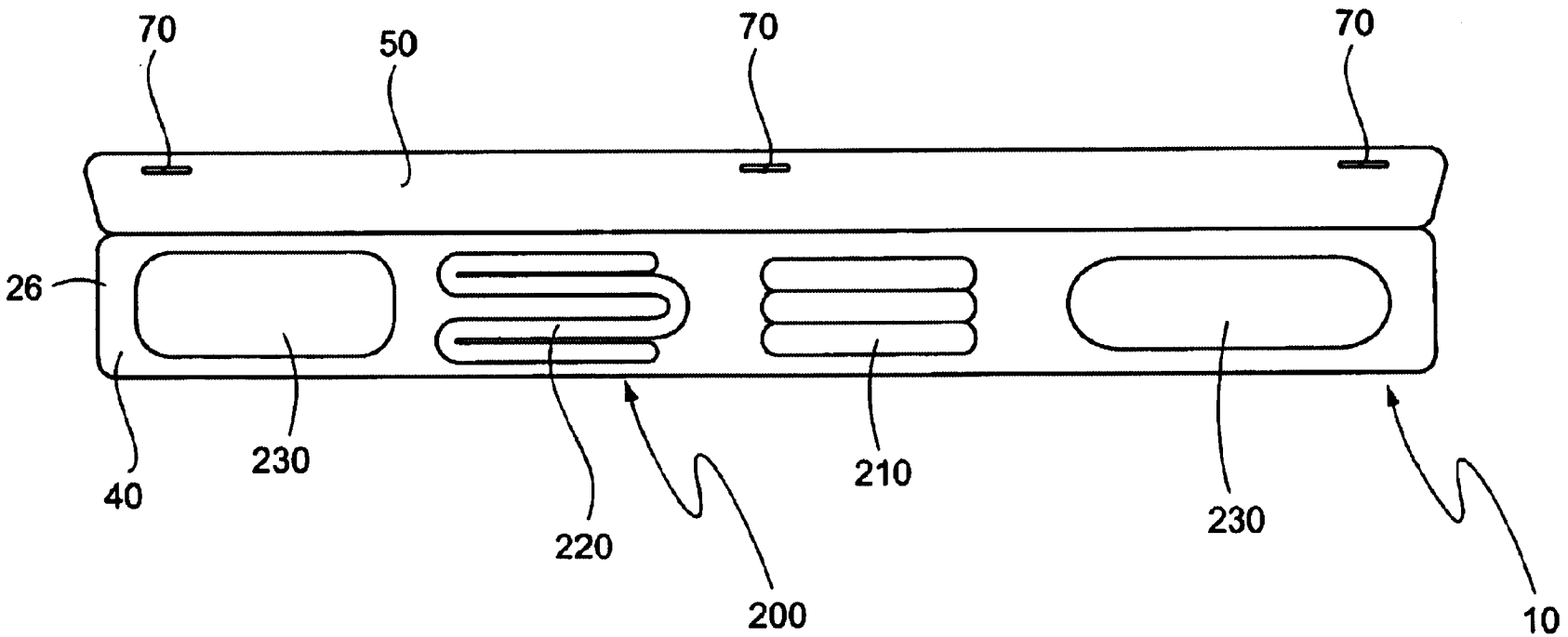
FIG. 2 is a top view of the present invention shown in an opened position.

As shown in FIG. 2, bedding 200, such as, for example, sheets 210, blankets 220, pillows 230, and the like, is positioned within the storage area 40 as desired by the user.

Referring back to FIG. 1, a lid 50, as desired, is preferably hingedly secured to the rear wall 24 of the pouch 20. The lid 50 is preferably selectably positioned over the lip 60 of the front wall 22 of the pouch 20 to allow closure of the pouch 20 as desired by the user.

The walls 22, 24, and 26 of the pouch 20 are rigid, semi-flexible or flexible, or any combination or degree thereof as desired.

As desired, a fastening means 65, such as, for example, openings 70 formed along the lid 50 in corresponding relation to buttons 80 affixed to the pouch 20 is used to secure the lid 50 to the pouch 20. The openings 70 receive the buttons 80, thereby securing the bedding storage container 10 in a closed position.

An alternative embodiment of the present invention includes a fastening means 65, such as, for example, at least one hook-and-loop fastener assembly 200 having a part 201 of the hook-and-loop fastener assembly 200 affixed to the lid 50 in corresponding relation to a mating part 202 of the hook-and-loop fastener assembly 200 affixed to the pouch 20. The part of the hook-and-loop fastener assembly 200 receives the mating part 202, thereby securing the container 10 in a closed position. A typical hook-and-loop fastener assembly 200 as known in the art includes one part 201 being a fabric surface formed with nappy strands to accept a mating part 202 being a hook surface incorporating small hooks that affix themselves to the fabric surface when the two parts 201, 202 are brought into proximity with each other. With respect to qualities of adhesion or securing, it generally makes no difference which part 201, 202 is affixed to either the lid 50 or the pouch 20, as long as the other part 202, 201 is affixed in corresponding relation so as to allow the lid 20 to be affixed to the pouch 20. Therefore with respect to this invention, a part 201 of a hook-and-loop fastener assembly 200 can include either a nappy surface or a hook surface, as can a mating part 202. Clearly, however, a part 201 of the hook-and-loop fastener assembly 200 must include the other of the surface chosen for the mating part 202 in order for affixing to occur when the two parts 201, 202 are brought into proximity with one another.

Figure 3A:
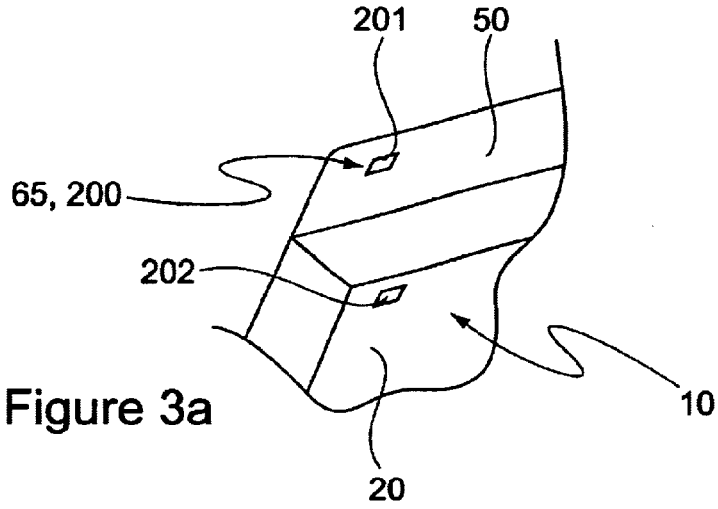
FIG. 3*a* is a perspective view of one preferred embodiment of the present invention showing details of a fastening means.
Figure 3B:
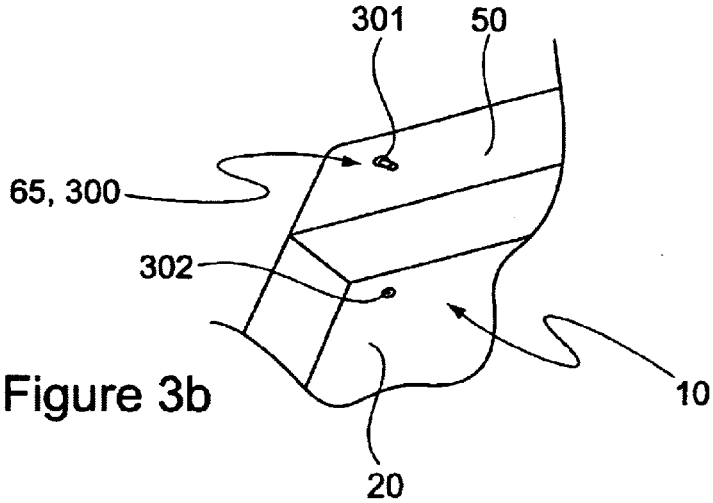
FIG. 3*b* is a perspective view of one preferred embodiment of the present invention showing details of an alternative fastening means.
Figure 3C:
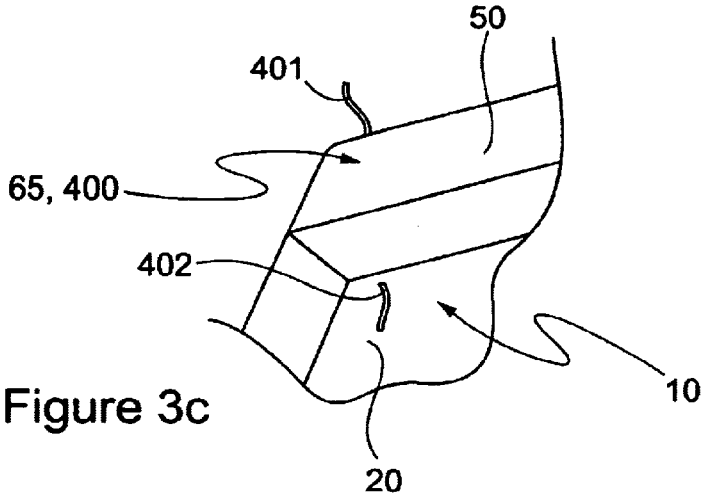
FIG. 3*c* is a perspective view of one preferred embodiment of the present invention showing details of yet another alternative fastening means.

Likewise, another embodiment of the present invention includes a fastening means 65, such as, for example, at least one snap assembly 300 having a part 301 of the snap assembly 300 affixed to the lid 50 in corresponding relation to a mating part 302 of the snap assembly 300 affixed to the pouch 20. The part of the snap assembly 301 is received by the mating part 302, thereby securing the container 10 in a closed position. A typical snap assembly 300 as known in the art includes a mating part 302 having a female end and further having an orifice formed to accept a part 301 having a projecting male end thereby affixing one part 301, 302 to the other part 302, 301 when the two ends are brought into proximity with each other. In a fashion similar to the case of a hook-and-loop fastener assembly 200 (see FIG. 3*a*) as described above, with respect to qualities of adhesion or securing, it generally makes no difference which part 301, 302, either one having a male end or a female end, is affixed to either the lid 50 or the pouch 20, as long as the other part 302, 301 is affixed in corresponding relation so as to allow the lid 20 to be affixed to the pouch 20. Therefore with respect to this invention, a part 301 of a snap assembly 300 can include either a male or a female end, as can a mating part 302. Clearly, however, a part 301 of the snap assembly 300 must include the other of the end chosen for the mating part 302 in order for affixing to occur when the two parts 301, 302 are brought into proximity with one another.

Yet an even further embodiment of the present invention includes a fastening means 65, such as, for example, at least one cord assembly 400 having a cord 401 of the cord assembly 400 affixed to the lid 50 in corresponding relation to a mating cord 402 of the cord assembly 400 affixed to the pouch 20. The cord 401 of the cord assembly 402 receives the mating cord 402, thereby securing the container 10 in a closed position. As known in the art, a cord 401 is typically tied to a mating cord 402 by means of one or a combination of many knots known to those skilled in the art of rope-tying or the like. The use of such knots thereby results in affixing a cord 401 to mating cord 402 when the cords 401, 402 are brought into proximity with each other.

Further embodiments (not shown) feature the use of additional fastening means 65 including, but not limited to, those illustrated in the Figures. Such fastening means 65 are affixed to the lid 50 and in corresponding relation to the straps 30 in order to secure the lid 50 in an open position (as shown in FIG. 1), as desired, in order to facilitate to stowing of bedding 200 into the container 10.

In use, the bedding storage container 10 is attached to and preferably behind; however, attachment underneath exists in other embodiments, a bed such as, for example, the futon 100 thereby requiring little or no additional space beyond that space which the futon 100 already utilizes. A practical benefit of use of the present invention is that the bedding 200 is stored within the storage area 40 and is therefore preferably behind, or alternatively, underneath, the futon 100, in space that typically would be otherwise wasted if not utilized by the present invention, and out of sight of a user or other persons observing the futon 100.

There are other notable advantages of the present invention. For example, the present invention works with a variety of futon frame assemblies 110. Straps 30 are provided with enough length to accommodate known vertical surfaces 112 and to even allow pulling of the container 10 over the top of the Futon 100 for ease in use when filling or emptying the container 10 of bedding 200. Once the present invention is installed and adjusted, use is simple in that a user simply opens the lid 50, places bedding 200 in the storage area 40 as desired, and closes the lid 50, optionally securing the lid 50 in a closed position by engaging the fastening means 65. Not only can the present invention be used with futons 100, but the present invention may also be used on any variety of furniture or even in closets (not shown). Whether or not bedding 200 is stored within, no parts of the present invention need be removed or stored apart from an installed position on a vertical surface 112.

The detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A combination comprising:

a furniture that converts from a couch to a bed and having a generally vertical back surface that, when in the couch configuration, slopes inwardly from top to bottom, said furniture further comprising frame members exposed at said sloping back surface, and a storage container for detachably mounting to the back surface of said furniture, said storage container further comprising a pouch defining a storage area for bedding items, and fasteners for detachably mounting said storage container to said frame members such that the storage container generally conforms to the sloping back surface.

2. The combination of claim 1 wherein said fasteners further comprise straps for detachably mounting said storage container to said frame members.

3. The combination of claim 1 wherein said furniture further comprises a horizontal surface extending rearwardly from said sloping back surface, said storage container being supported on said support surface.

4. The combination of claim 1 wherein said storage container further comprises a lid hingedly attached at the top of said pouch.

5. The combination of claim 1 wherein at least portions of said pouch are semi-flexible or flexible.

6. The combination of claim 1 wherein said pouch has a front wall, a rear wall, a bottom wall, and side walls, said fasteners mounting said storage container with the rear wall of said storage container generally conforming to the sloping back surface of said furniture.

7. The combination of claim 1 wherein said fasteners further comprise at least one hook-and-loop fastener assembly.

8. The combination of claim 1 wherein said fasteners further comprise at least one snap assembly.

9. The combination claim 1 wherein said fasteners further comprise at least one cord assembly.

10. The combination of claim 4 further comprising a fastener for holding said lid in a closed position overlying the top of said pouch.

11. A combination comprising:

a furniture of the futon type that converts from a couch to a bed and having a generally vertical back surface that, when in the couch configuration, slopes inwardly from top to bottom, and a storage container for detachably mounting to the back surface of said furniture, said storage container further comprising a pouch defining a storage area for bedding items, and fasteners for detachably mounting said storage container to the sloping back surface of said furniture such that the storage container generally conforms to the sloping back surface.

12. The combination of claim 11 wherein said furniture further comprises exposed frame members, and wherein said fasteners are adapted to fasten said storage container to said frame members.

13. The combination of claim 12 wherein said the frame members are exposed at said sloping back surface.

14. The combination of claim 12 wherein said fasteners further comprise straps for detachably mounting said storage container to said frame members.

15. The combination of claim 11 wherein said furniture further comprises a horizontal surface extending rearwardly from said sloping back surface, said storage container being supported on said support surface.

16. The combination of claim 11 wherein said storage container further comprises a lid hingedly attached at the top of said pouch.

17. The combination of claim 11 wherein at least portions of said pouch are semi-flexible or flexible.

18. The combination of claim 11 wherein said pouch has a front wall, a rear wall, a bottom wall, and side walls, said fasteners mounting said storage container with the rear wall of said storage container generally conforming to the sloping back surface of said furniture.

19. The combination of claim 11 wherein said fasteners further comprise at least one hook-and-loop fastener assembly.

20. The combination of claim 11 wherein said fasteners further comprise at least one snap assembly.

21. The combination of claim 11 wherein said fasteners further comprise at least one cord assembly.

22. The combination of claim 16 further comprising a fastener for holding said lid in a closed position overlying the top of said pouch.

23. A combination comprising:

a furniture of the futon type that converts from a couch to a bed and having a generally vertical back surface that, when in the couch configuration, slopes inwardly from top to bottom, and a storage container for detachably mounting to the back surface of said furniture, said storage container further comprising a pouch defining a storage area for bedding items, and fasteners for detachably mounting said storage container to the sloping back surface of said furniture.

24. The combination of claim 23 wherein said furniture further comprises exposed frame members, and wherein said fasteners are adapted to fasten said storage container to said frame members.

25. The combination of claim 24 wherein said frame members are exposed at said sloping back surface.

* * * * *